US005299482A

United States Patent [19]

Schmitt

[11] Patent Number: 5,299,482

[45] Date of Patent: Apr. 5, 1994

[54] VERTICAL DIE CUTTER

[75] Inventor: Thomas E. Schmitt, Dauphin, Pa.

[73] Assignee: Progressive Service Die Company, St. Louis, Mo.

[21] Appl. No.: 980,352

[22] Filed: Nov. 23, 1992

[51] Int. Cl.[5] ..... B26D 1/02

[52] U.S. Cl. ..... 83/566; 83/437; 83/639.3; 83/639.5; 83/857; 83/914

[58] Field of Search ..... 83/639.1, 639.3, 639.5, 83/566, 567, 568, 13, 914, 401, 437, 856, 857

[56] References Cited

U.S. PATENT DOCUMENTS 3,472,109 10/1969 Haas et al. ..... 83/639.1 X
3,813,978 6/1974 Spengler ..... 83/566 X
4,277,996 7/1981 Spengler ..... 83/639.3 X
4,610,650 9/1986 Piggott ..... 83/566 X
5,012,713 5/1991 Schmitt ..... 83/639.3

*Primary Examiner*—Eugenia Jones
*Attorney, Agent, or Firm*—Paul M. Denk

[57] ABSTRACT

An apparatus for cutting a three-dimensionally shaped work-piece includes a frame, a first surface movably mounted on the frame, a mold mounted on the first surface for receiving the work piece and having an approximate shape which conforms to the final desired shape of the work piece, a second surface mounted on the frame above the first surface, and dies mounted on the underside of the second surface. An inflatable bladder is positioned beneath the first surface to raise and lower the first surface between an elevated position in which a workpiece may be cut and a lowered position in which a cut workpiece may be removed or a workpiece may be positioned for cutting.

5 Claims, 3 Drawing Sheets

VERTICAL DIE CUTTER

BACKGROUND OF THE INVENTION

This invention relates to the forming and cutting of three-dimensional work-pieces which incorporate inherent contours, and, more particularly, to an apparatus for performing such operations.

In the manufacture of certain types of three-dimensional items, for example, the carpeting used in automobile flooring and for door interior side panels, the item or work piece is placed in a mold which is mounted in a frame of some type. The mold is moved into position adjacent a series of arranged cutting knives which are arranged to cut the work-piece to conform to its final three-dimensional shape in one operation.

To cut the work-piece, the frame holding the knives is raised, the work-piece is moved into place over the mold, the knife holding frame is then lowered to a position just above the work-piece, and the knives are operated to cut the work-piece. Often, the knife holding frame is raised using a hook and chain. This places a constraint on where the die cutting press may be placed. The building in which it is located must have equipment in place to raise the knife holding frame. If a pulley system is to be used, the ceiling of the building must be strong enough to support the knife holding frame and may therefore need to be reinforced before the machine is used.

The equipment presently used to cut three-dimensional work-pieces has drawbacks. Among these are its cost, its size, its complexity, and its difficulty in use. It would be advantageous to have equipment which is compact and relatively easy to use, which requires less manipulation, which has fewer positioning constraints, and which is less expensive than the overly complex machinery currently available.

SUMMARY OF THE INVENTION

Among the several objects and advantages of the present invention may be noted the provision of an apparatus for forming and cutting items such as carpeting for automobiles and the like from workpieces placed in a mold.

Another object is the construction of an apparatus which will cut such molded items from three-dimensionally arranged work-pieces in a single cutting operation.

Yet another object is to provided a cutting apparatus which is compact and has few positioning constraints.

These and other objects will become apparent to those skilled in the art in view of the following disclosure and accompanying drawings.

In accordance with the invention, generally stated, there is provided an apparatus for cutting a three-dimensionally shaped work-piece. The apparatus includes a frame, a first surface movably mounted on the frame, a mold mounted on the first surface for receiving the work piece and having a shape which conforms to the final desired shape of the work piece, a second surface mounted on the frame above the first surface, and a die or series of arranged diesmounted on the underside of the second surface. The first surface is movable between an elevated position in which the workpiece is cut and a lowered position in which a cut workpiece may be removed or a workpiece may be positioned on the mold for cutting. An inflatable bladder is positioned beneath the first surface to raise and lower the first surface between its elevated and operative position and its lowered position for application or removal of a piece to be worked on or cut.

DESCRIPTION OF THE PREFERRED EMBODIMENT

Figure 4:
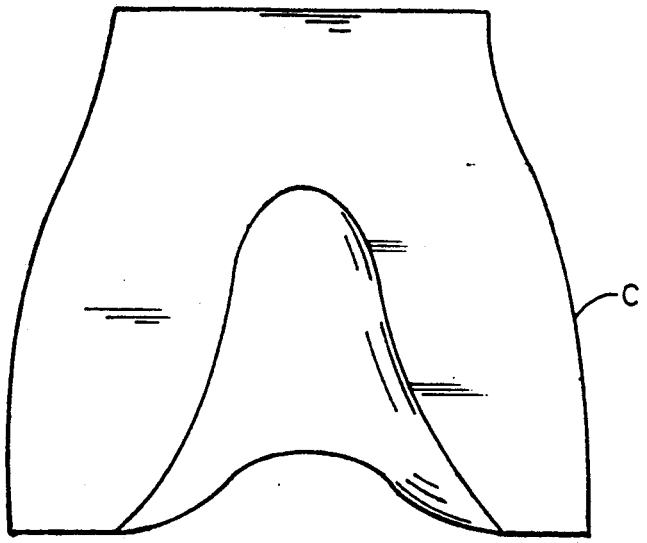
FIG. 4 is a top plan view of a work-piece when cut.

Referring to the drawings, an apparatus for cutting a three-dimensionally shaped work-piece is shown generally at 1. The work-piece may be one of many different types of material, for example, a carpet C as shown in FIG. 4 which may be used for installation in an automobile as part of the flooring for the vehicle. It will be understood that the finished item formed from the work-piece has to conform to a particular size and shape, and apparatus 1 is designed to produce such a completed item which so conforms. While the following description of the construction and operation of apparatus 1 is made with respect to the manufacturing of an automobile carpet, the apparatus is readily adaptable to cutting out different types of pieces from a plurality of materials for a variety of applications without significant modification.

Apparatus 1 includes a frame assembly 3. Frame assembly 3 has a base 5 made of support members 7 which are joined at their ends. The ends of base members 7 are raised, as at 9, relative to the mid-section of members 7, to define platforms 11.

Figure 2:
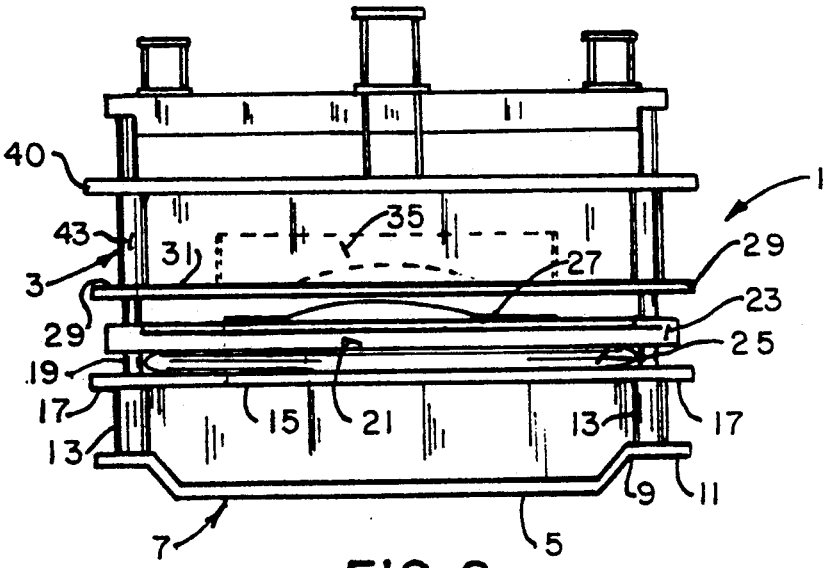
FIG. 2 is an end elevational view of the cutting apparatus.

Legs 13 are secured to platform 11, and extend upwardly therefrom. A table or surface 15 is placed above legs 13. As can be seen in FIG. 2, surface 15 and legs 13 may be integral. Table 15 includes platforms 17 formed at its corners. Platforms 17 support cylinders 19 which extend upwardly therefrom.

Figure 5:
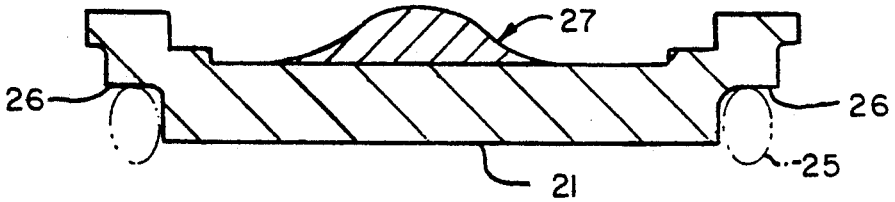
FIG. 5 is a transverse sectional view of the mold, partly in cross-section, taken along line 5—5 of FIG. 3.

A surface 21 is slidably received on cylinders 19. Surface 21 has journals 23 at its corners which are slidably received on cylinders 19. A plurality of inflatable bellows or bladders 25 are positioned around the perimeter of surface 15, between surface 15 and surface 21. Bladders 25 are operatively connected to a source of pressure which may be selectively operated to inflate and deflate the bladders. As will be discussed below, bladders 25 inflate and deflate to raise and lower surface 21. As can be seen in FIG. 5, surface 21 is stepped, as at 26. Bladders 25 are received under steps 26.

Figure 3:
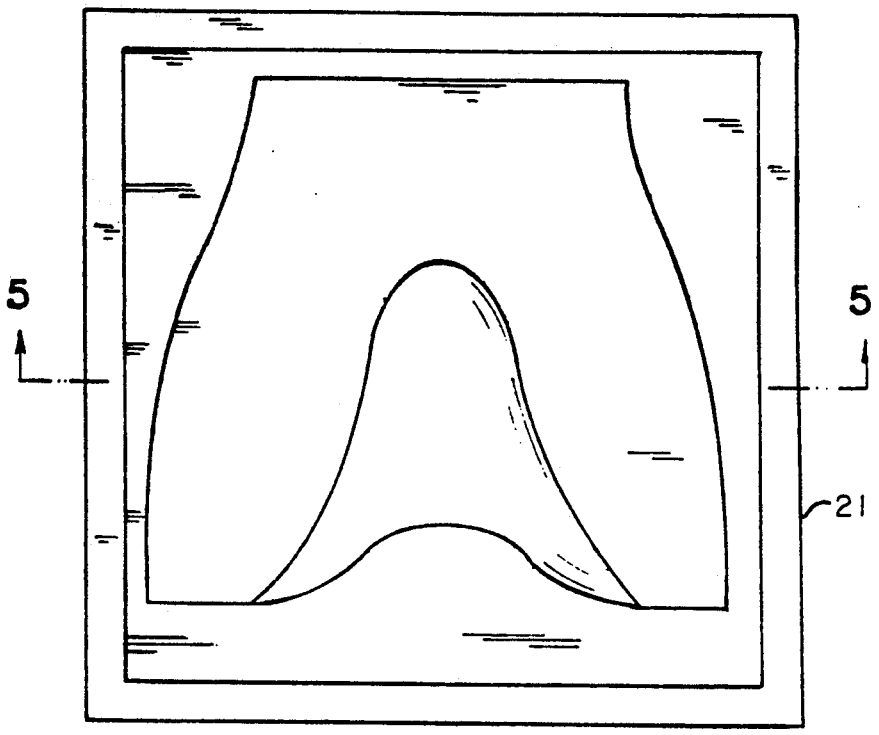
FIG. 3 is a top plan view of a three-dimensional mold upon which a work-piece is placed.

A mold 27 is carried on surface 21. As shown in FIGS. 3 and 5, the mold is three-dimensionally shaped to receive a work-piece to be cut or formed into finished items, such as carpet C shown in FIG. 4. The mold is formed to have a three-dimensional shape conforming to the final shape of the work-piece. Consequently, when a work-piece is set onto the mold, it assumes the shape of the completed item to be cut by the apparatus, and only one cutting operation need be performed for each item.

Figure 1:
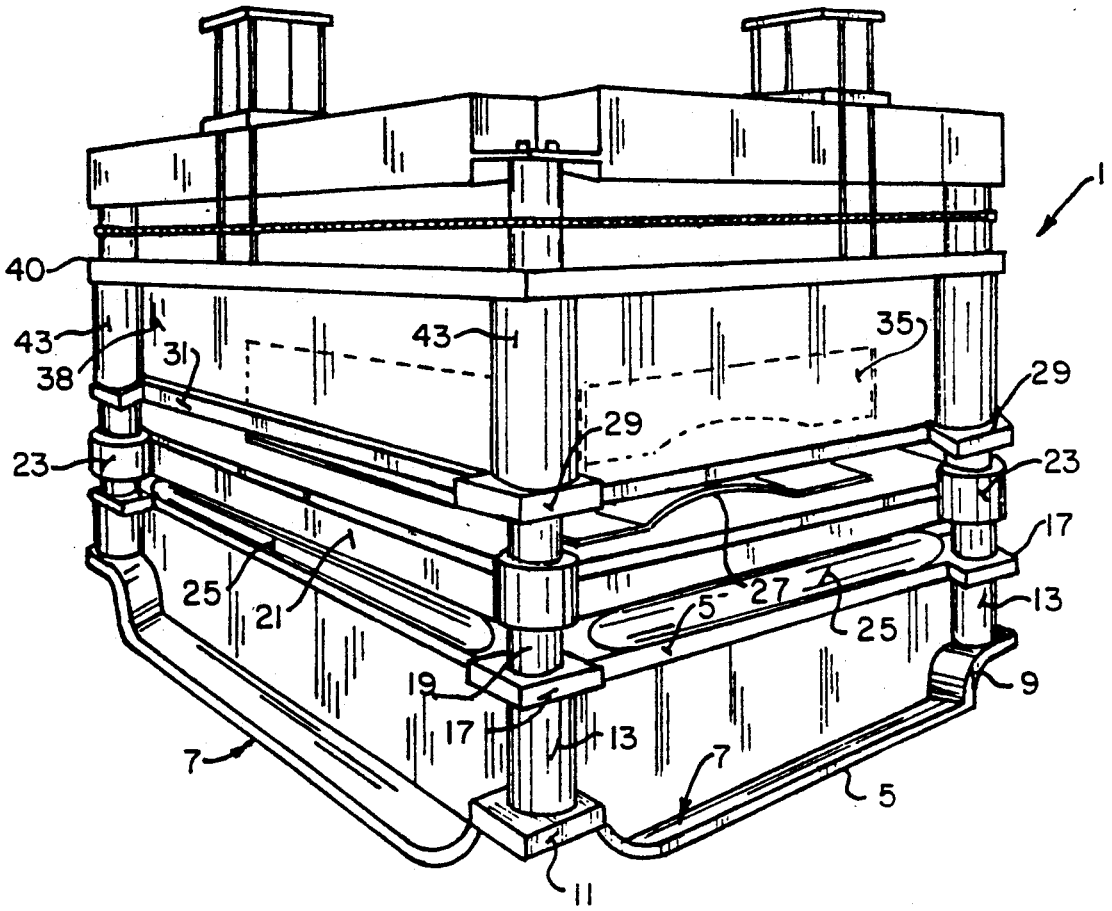
FIG. 1 is a perspective view of a cutting apparatus of the present invention, a cutting frame being shown in phantom line.
Figure 6:
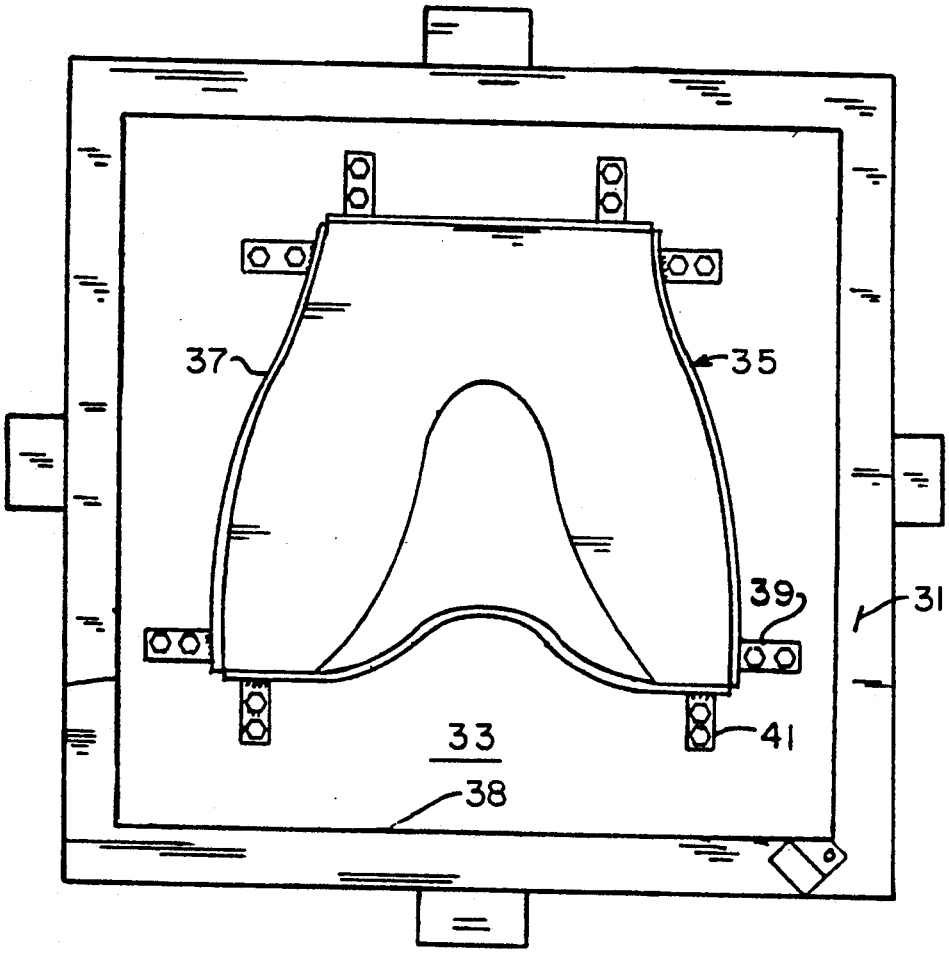
FIG. 6 is a bottom plan view of an upper frame showing cutting dies arranged in the upper frame for cutting the work-piece.

Upper platforms 29 are secured to the top of cylinders 19. Upper platforms 29 support an upper frame 31. As best shown in FIG. 6, upper frame 31 has an inner surface 33 to which a die 35 having cutting edges 37 is secured. Frame 31 also has side walls 38 (FIG. 1) which surround die 35. Columns 43, positioned at the corners of frame 31, extend upwardly from platforms 29. Walls 38 extend between columns 43. A top 40 is placed over walls 38 to close frame 31.

Die 35 has brackets 39 which extend outwardly therefrom and through which bolts 41 extend to secure the die to surface 33 of upper frame 29. Dies 35, may of course, be secured to upper frame 29 in any manner. However, it is preferably that it be removably secured, as is shown, so that it may be replaced for maintenance or to be replaced with a different shaped dies. Dies 35 is three-dimensionally shaped to conform to the shape of the mold.

In operation, with the bladder 25 uninflated, a work-piece is positioned on mold 27. By inflating bladders 25, platform 21 is elevated and the work-piece is raised to be brought into contact with the die 35 and its knives 37. The bladder is then further inflated, causing the work-piece to be cut by knives 37 to the desired shape in a single operation. To remove the cut work-piece from the mold, the bladder is deflated to lower frame 21.

Bladders 25 may be pneumatic or hydraulic. They are connected to a source of hydraulic or pneumatic pressure so that they may be inflated. The hydraulic or pneumatic system also includes a valve or by-pass mechanism so that the bladder may be deflated. Any conventional hydraulic or pneumatic system may accomplish this function. Also, various shielding means may be provided around the bladders to confine and locate them.

Numerous variations, within the scope of the appended claims will be apparent to those skilled in the art. The bladder can be arranged in any number of ways. For example, bladder 25 may be a single bladder which extends around the periphery of surface 21 in step 26, or it may be four separate bladders. Alternately, there may be a plurality of parallel bladders laying across surface 15. The foregoing disclosure is illustrative only, and is not limiting.

Having thus described the invention, what is claimed and desired to be secured by Letters Patent is:

1. An apparatus for cutting a three-dimensionally shaped work-piece comprising:

a frame;

a first member movably mounted onto said frame;

a mold mounted on said first member for receiving said work-piece, the mold having a shape which conforms to a final desired shape of the work-piece;

a second member mounted on said frame above said first member, said first member being vertically movable with respect to said second member;

cutting means carried by said second member, said cutting means being pre-positioned to cut the work-piece in the desired shape when said first member is moved to a position immediately beneath said second member;

means for vertically moving said first member to said position immediately beneath said second member to cut said work-piece, said moving means includes at least one inflatable bladder positioned beneath said first member and arranged around its perimeter, said bladder being inflatable to raise said first member to bring said work-piece to said position immediately beneath said second member and being deflatable to lower said first member;

a third member mounted on said frame and disposed beneath said first member, said bladder being supported by said third member.

2. The apparatus of claim 1 wherein said first member has an underside which is stepped at the edges thereof, said bladder being positioned under the stepped edges.

3. The apparatus of claim 2 wherein said mold comprises a three-dimensional mold, and wherein said cutting means is a die which conforms to the shape of said mold to cut said work-piece to a three dimensional shape in one cutting operation.

4. The apparatus of claim 3, wherein said die and said mold are removably secured to said second and first members, respectively.

5. The apparatus of claim 1 wherein columns extend upwardly from said third member, said first member having journals which are slidably received on said columns.

* * * * *